US006447094B1

(12) United States Patent
Berg et al.

(10) Patent No.: US 6,447,094 B1
(45) Date of Patent: Sep. 10, 2002

(54) FIRMWARE SENSORING SYSTEMS AND METHODS FOR A MAINTENANCE MECHANISM OF AN INK JET PRINTER

(75) Inventors: Richard H. Berg, Rochester; Charles T. Facchini, II, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 18 days.

(21) Appl. No.: 09/718,345

(22) Filed: Nov. 24, 2000

(51) Int. Cl.[7] ..... B41J 2/165

(52) U.S. Cl. ..... 347/22; 347/29; 347/30; 347/33

(58) Field of Search ..... 347/22, 23, 14, 347/29, 33, 32, 30, 24, 37; 400/279, 903, 322; 318/640, 696, 685

(56) References Cited

U.S. PATENT DOCUMENTS

| | | | | |
|---|---|---|---|---|
| 4,544,931 A | * | 10/1985 | Watanabe et al. | 347/17 |
| 4,746,938 A | | 5/1988 | Yamamori et al. | 347/28 |
| 4,853,717 A | | 8/1989 | Harmon et al. | 347/29 |
| 4,855,764 A | | 8/1989 | Humbs et al. | 347/31 |
| 5,075,609 A | * | 12/1991 | Ito et al. | 318/696 |
| 5,151,715 A | | 9/1992 | Ward et al. | 347/33 |
| 5,250,962 A | | 10/1993 | Fisher et al. | 347/32 |
| 5,339,102 A | | 8/1994 | Carlotta | 347/32 |
| 5,500,659 A | | 3/1996 | Curran, Jr. et al. | 347/28 |
| 5,548,310 A | | 8/1996 | Binnert et al. | 347/33 |
| 5,659,341 A | | 8/1997 | Kinas | 347/33 |
| 5,943,071 A | | 8/1999 | Premnath | 347/33 |
| 6,130,684 A | | 10/2000 | Premnath et al. | 347/30 |
| 6,220,327 B1 | * | 4/2001 | Rothwell et al. | 156/387 |
| 6,312,093 B1 | * | 11/2001 | Saijo et al. | 347/30 |

* cited by examiner

*Primary Examiner*—Craig Hallacher
*Assistant Examiner*—Shih-Wen Hsieh
(74) *Attorney, Agent, or Firm*—Oliff & Berridge, PLC

(57) ABSTRACT

A firmware sensoring system and method includes a driving and control portion for rotating a cam shaft to actuate various maintenance operations of a maintenance station. In various exemplary embodiments, the driving and control portion includes a sensor wheel that rotates with the cam shaft. In an exemplary embodiment, the sensor wheel has an optical window formed therein. The optical window may be aligned with an optical relay in both an extreme clockwise position of the cam shaft and an extreme counterclockwise position of the cam shaft. Depending on whether the optical window is aligned with the optical relay or not, the optical relay is in either a closed-circuit condition or an open-circuit condition. The condition of the optical relay is communicated to or sensed by a controller that rotates the cam shaft.

22 Claims, 6 Drawing Sheets

FIRMWARE SENSORING SYSTEMS AND METHODS FOR A MAINTENANCE MECHANISM OF AN INK JET PRINTER

BACKGROUND OF THE INVENTION

1. Field of Invention

This invention relates to systems and methods for sensoring a maintenance station usable with an ink jet printer.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to or less than the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a maintenance station having a cam shaft that sequentially activates wiping, capping and priming operations.

This invention separately provides systems and methods that allow a rotational position of a cam shaft to be sensed, detected and/or monitored.

This invention separately provides systems and methods that allow accurate timing of operations of a maintenance station.

This invention separately provides systems and methods for maintaining the timing of operations of the maintenance station.

This invention separately provides improved efficiency for operations of a maintenance station.

In various exemplary embodiments of the systems and methods of this invention, a sensor wheel is arranged to rotate with a cam shaft of a maintenance station. An optical window is formed in the sensor wheel. An optical relay is arranged to sense a rotational position of the cam shaft by locating the optical window of the sensor wheel.

In various exemplary embodiments, a controller drives the cam shaft based on a condition of the optical relay.

In various exemplary embodiments of the systems and methods of this invention, a sensor wheel is arranged to rotate with a cam shaft of a maintenance station. In various exemplary embodiments, at least a portion of the sensor wheel is made of metal. In various other exemplary embodiments, the sensor wheel is made of metal and includes a portion that has a different thickness than the rest of the sensor wheel. A magnetic flux source generates a magnetic field that is at least partially intersected by the sensor wheel. A magnetic flux sensor is arranged to determine a rotational position of the cam shaft by sensing changes in the magnetic field caused by rotation of the sensor wheel.

In various exemplary embodiments, a controller drives the cam shaft based on the magnetic field sensed by the magnetic flux sensor.

In various other exemplary embodiments of the systems and methods of this invention, a sensor wheel is arranged to rotate with a cam shaft of a maintenance station. A mechanical element is formed on the sensor wheel. A mechanical sensor is arranged to determine a rotational position of the cam shaft by cooperating with the mechanical element.

In various exemplary embodiments, a controller drives the cam shaft based on the position of the mechanical element.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
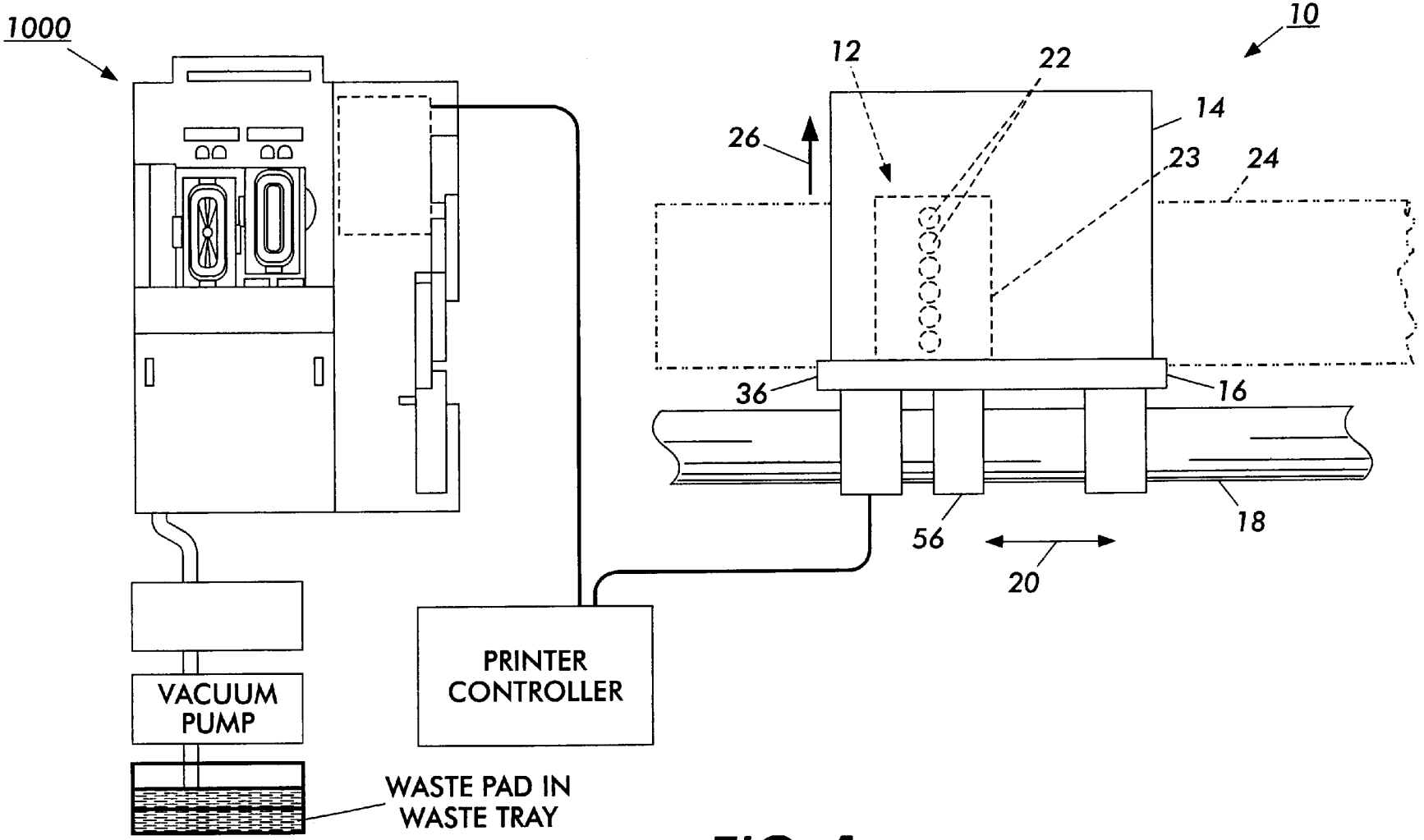
FIG. 1 is a schematic front elevation view of an ink jet printer and an exemplary maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by the arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of the arrow 26 for the distance or the height of one printed swath or less. U.S. Pat. Nos. 4,571,599 and Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
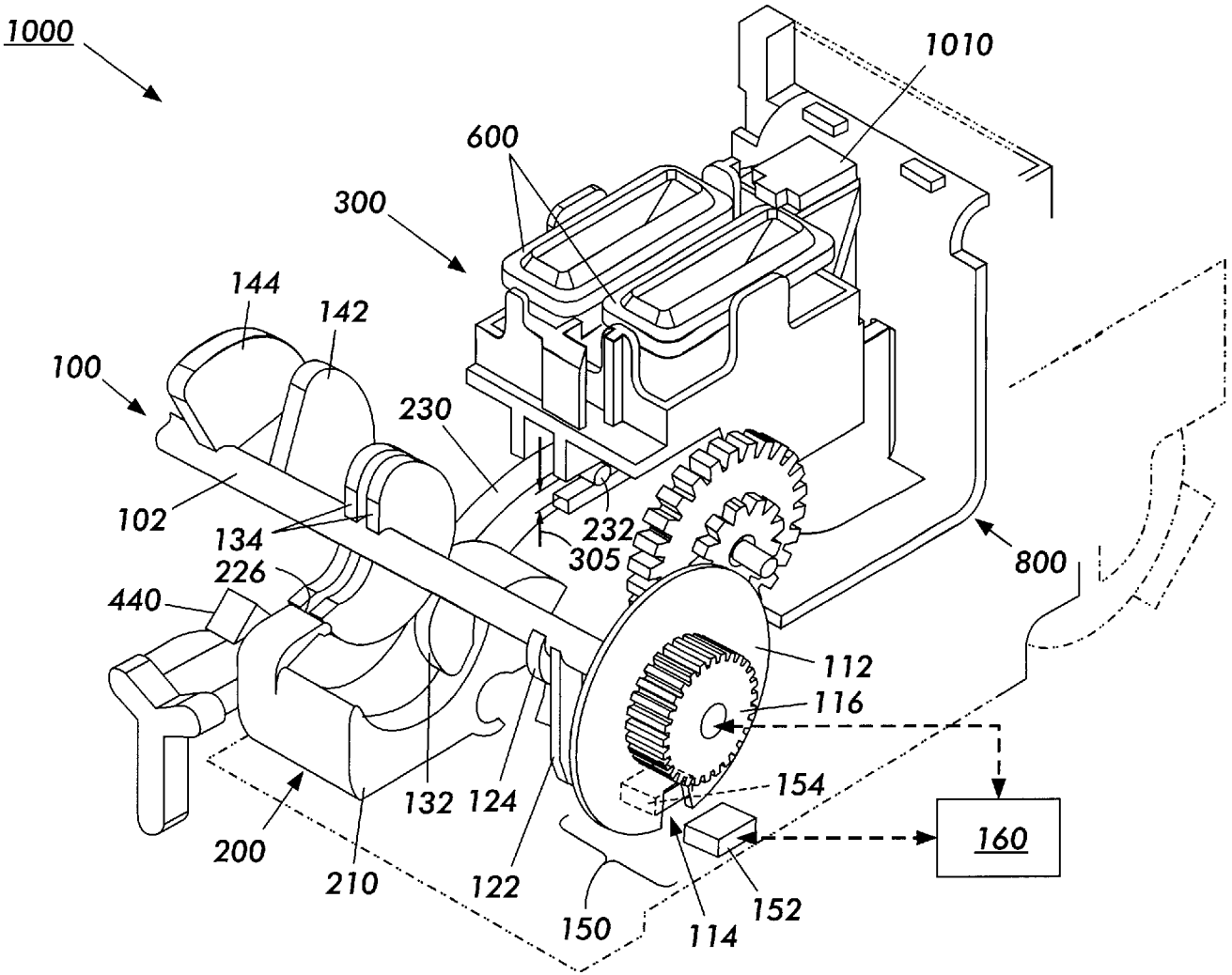
FIG. 2 is a top perspective view of the interior of the exemplary maintenance station of FIG. 1 showing a first exemplary embodiment of a sensing arrangement according to this invention.

FIG. 2 is a top perspective view of the exemplary maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2, and more clearly seen in FIG. 3, the cam shaft 100 includes a driving and control portion 110, a wiper blade drive portion 120, a cam-actuated lever capping arm drive portion 130 and a pinch tube actuating portion 140.

Figure 3:
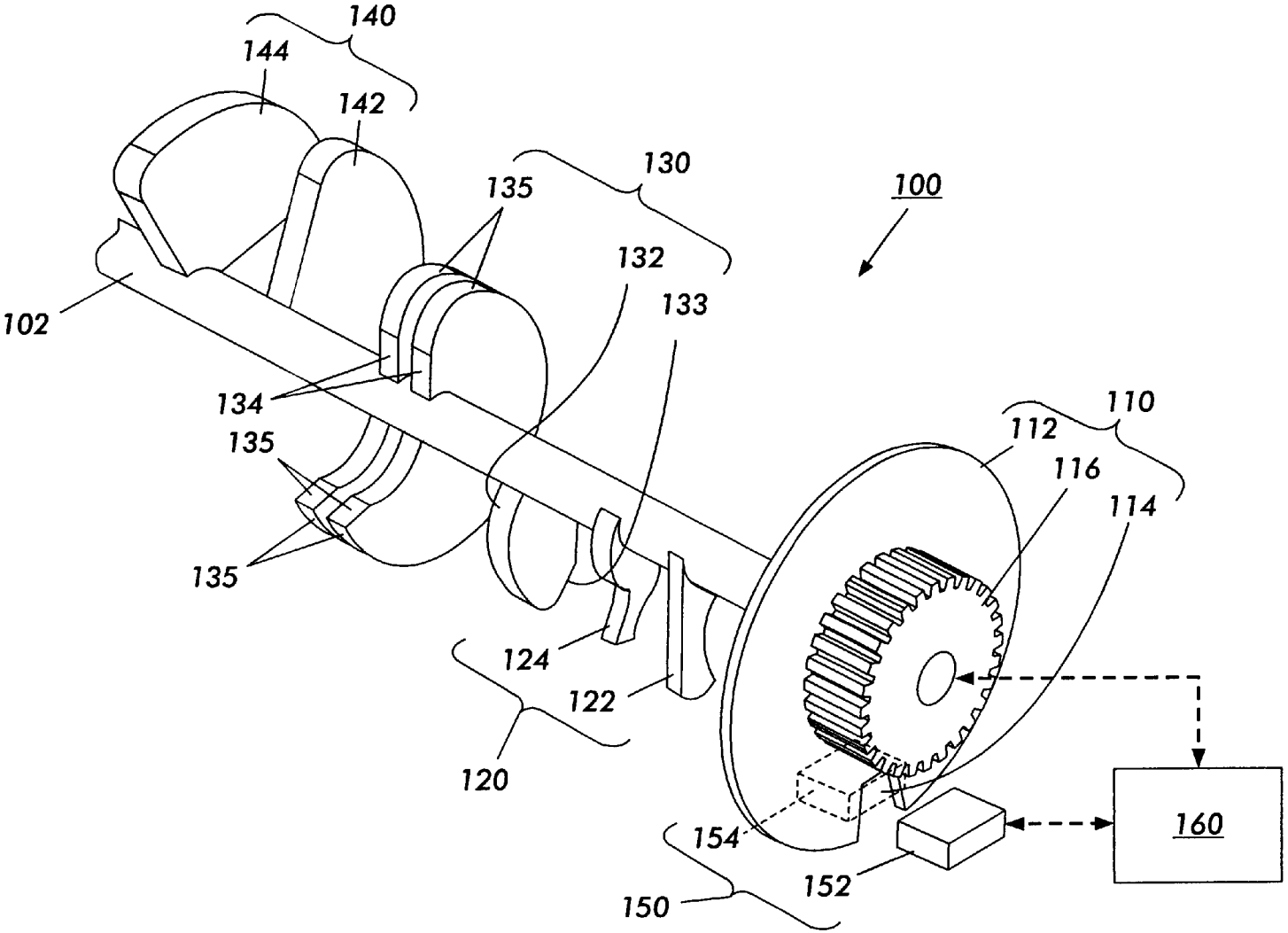
FIG. 3 is a partial perspective view of the cam shaft and sensing arrangement of FIG. 2.
Figure 6:
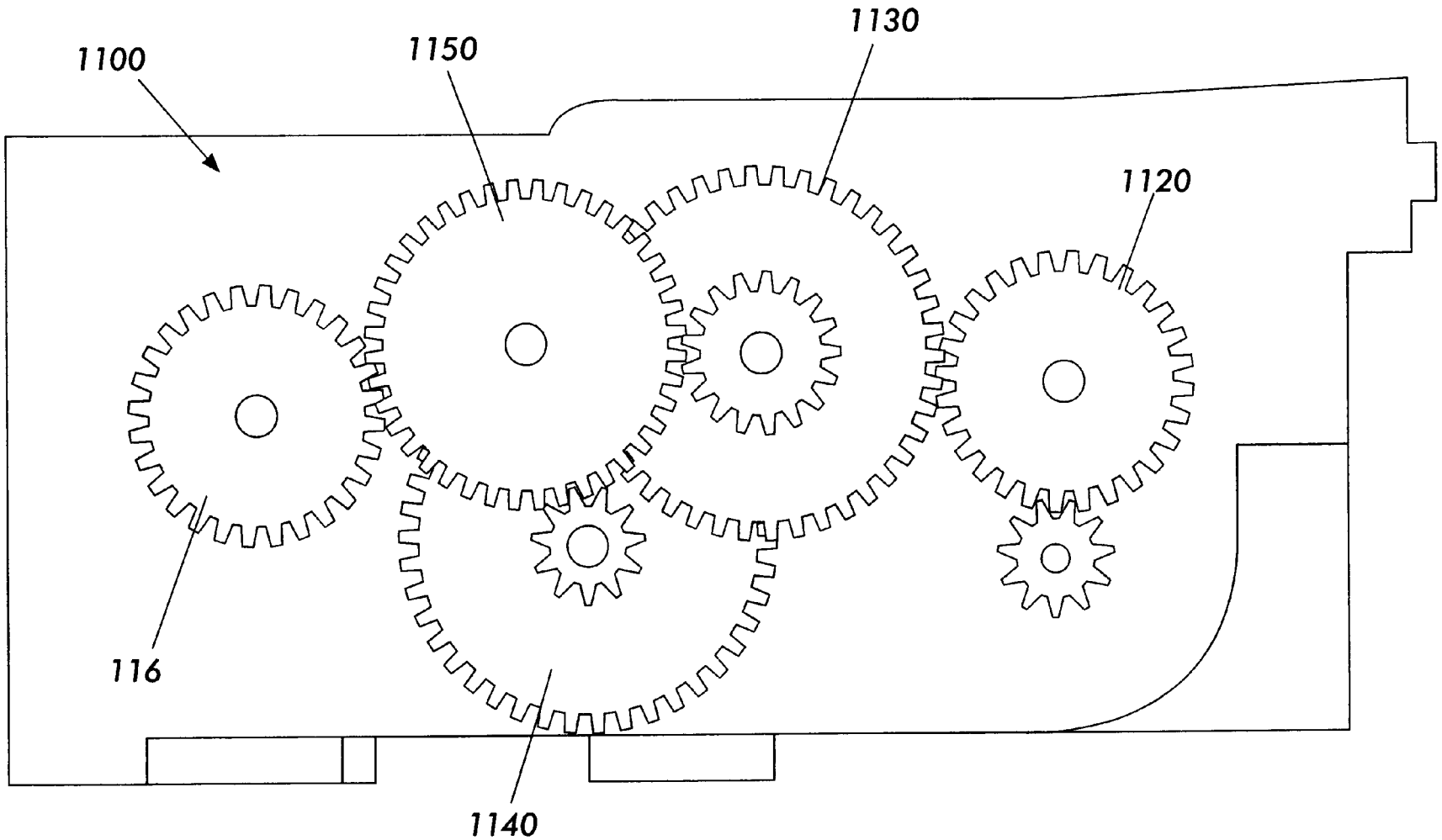
FIG. 6 is a perspective view of the exemplary maintenance station of FIG. 1 and gear train.

In a first exemplary embodiment of a sensing arrangement according to this invention, as shown in FIGS. 2 and 3, the driving and control portion 110 includes a sensor wheel 112, an optical window 114 formed in the sensor wheel 112, and a main drive gear 116. In operation, a drive gear train, one example of which is shown in FIG. 6, comprising a drive motor connected to one or more drive gears, engages the main drive gear 116 to drive the cam shaft 100 in counterclockwise and then clockwise directions to actuate the various maintenance functions enabled by the maintenance station 1000.

In each of an extreme clockwise position of the cam shaft 100 and the extreme counterclockwise position of the cam shaft 100, the optical window 114 is aligned with a sensor, such as an optical relay 150. Thus, after the drive gear train drives the main drive gear 116 to rotate the cam shaft 100 to the extreme clockwise or counterclockwise position, the optical window 114 formed in the sensor wheel 112 is aligned with the optical relay 150. In various exemplary embodiments, the optical relay 150 includes a photo-emitter 152 positioned on one side of the sensor wheel 112 and a photo-detector 154 positioned on the other side of the sensor wheel 112. When the optical window 114 is not aligned with the optical relay 150, the optical relay 150 is in an open-circuit condition.

While the sensor is shown as an optical relay in the exemplary embodiment of FIGS. 2 and 3, it should be understood that the sensor may be any suitable sensor that is capable of sensing the rotation of the sensor wheel 112. As such, it should be understood that the sensor may be any known or later developed sensor.

At the start of a maintenance operation, the sensor wheel 112 is in the extreme clockwise position and the optical window 114 is aligned with the optical relay 150 to close the circuit through the optical relay 150. As a result, when the one or more printheads 12 are aligned with the maintenance station 1000 and the main drive gear 116 is initially driven in the counterclockwise direction, the optical window 114 is no longer aligned with the optical relay 150 and the optical relay 150 is placed into the open-circuit condition. Then, when the sensor wheel 112 reaches its extreme counterclockwise position, the window 114 is again aligned with the optical relay 150. As a result, the optical relay 150 is again placed in the closed-circuit condition.

The open-circuit and closed-circuit conditions of the optical relay 150 are sensed by a controller 160. In response, the controller 160 stops the gear train engaged with the main drive gear 116 from turning the cam shaft 100 for a predetermined time. In particular, this predetermined time depends on the priming mode currently selected for the maintenance station 1000.

Once the predetermined time has elapsed, the controller 160 starts the gear train to drive the main drive gear 116, and thus the cam shaft, 100, in the clockwise direction. The cam shaft 100 continues rotating in the clockwise direction until the optical window 114 in the sensor wheel 112 is again aligned with the optical relay 150 to again put the optical relay 150 in the closed-circuit condition. When the controller 160 again senses the closed circuit condition of the optical relay 150, the controller 160 again stops the gear train from driving the main drive gear 116, and thus the cam shaft 100, in the clockwise direction.

In particular, in various exemplary embodiments, when the cam shaft 100 first begins rotating in the counterclockwise direction, the wiper blade portion 120 drives a wiper blade platform (not shown) from a first position to a second position. Then, when the cam shaft 100 is driven in the clockwise direction, the wiper blade drive portion 120 of the cam shaft 100 lastly drives the wiper blade platform from the second position back to the first position to wipe the nozzle face 23 of the one or more printheads 12 before the printhead 14 is moved from the maintenance station 1000 to the printing zone 24. However, it should be appreciated that in various other exemplary embodiments, the wiper blades 30 can be positioned so that the nozzle faces 23 are wiped when the wiper blade platform moves from the first position to the second position in addition to, or instead of, wiping when the wiper blade platform moves from the second position to the first position.

In various exemplary embodiments, after the wiper blade drive portion 120 moves the wiper blade platform from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 is driven in the clockwise direction, the cam-actuated lever capping arm drive portion 130 interacts with the cam-actuated lever arm 200 to move the capping carriage 300 from the engaged position to the disengaged position, before the wiper blade drive portion 120 moves the wiper blade platform from the second position back to the first position. This is described in greater detail in copending U.S. patent application Ser. No. 09/594,694, incorporated herein by reference in its entirety. The structure and operation of the printhead caps 600 are described in greater detail in copending U.S. patent applications Ser. Nos. 09/594,682 and 09/594,690, each incorporated herein by reference in its entirety.

Likewise, after the cam-actuated lever capping arm drive portion 130 moves the capping station 300 from the disengaged position to the engaged position, the cam shaft 100 rotates further in the counterclockwise direction. As a result, the pinch tube actuating portion 140 actuates one or more pinch tubes (not shown) to apply a negative pressure to the one or more printheads cap 600 mounted on the cap carriage 300. The structure and operation of the pinch tubes and pinch mechanism is described in greater detail in copending U.S. patent application Ser. No. 09/594,680, incorporated herein by reference in its entirety. The cam shaft 100 then continues to rotate in the counterclockwise direction until the cam shaft 100 reaches the extreme counterclockwise position. The controller 160, based on the signal from the optical relay 150 generated when the optical window 114 is aligned with the optical relay 150, maintains the cam shaft 100 in the extreme counterclockwise position for one of the predetermined times.

Then, after the predetermined time has elapsed, the controller 160 engages the drive motor of the drive gear train to rotate the cam shaft 100 in the clockwise direction. When the cam shaft 100 is rotated in the clockwise direction, the pinch tube actuation portion 140 again interacts with the one or more pinch tubes before the cap carriage 300 is moved from the engaged position to the disengaged position by the cam-actuated lever capping arm drive portion 130, which occurs before the wiper blade drive portion 120 moves the wiper blade platform from the second position to the first position.

Figure 4:
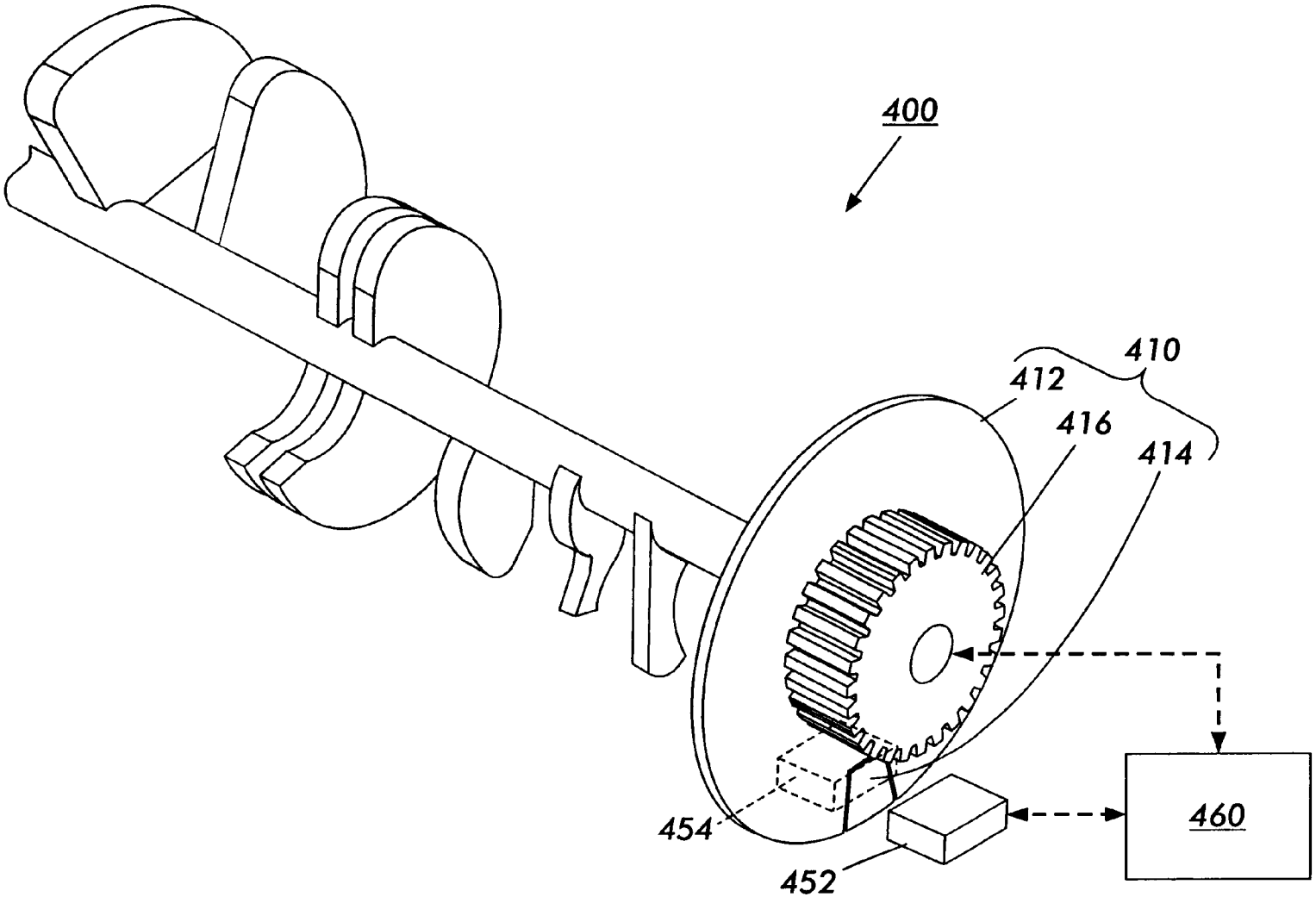
FIG. 4 is a partial perspective view of the cam shaft and a second exemplary embodiment of a sensing arrangement according to this invention.

In a second exemplary embodiment of a sensing arrangement according to this invention, as shown in FIG. 4, the driving and control portion 410 includes a sensor wheel 412 and a main drive gear 416. In operation, a drive gear train, one example of which is shown in FIG. 6, comprising a drive motor connected to one or more drive gears, engages the main drive gear 416 to drive the cam shaft 400 in counterclockwise and then clockwise directions to actuate the various maintenance functions enabled by the maintenance station 1000.

The sensor wheel 412 is arranged to rotate with the cam shaft 400. In various exemplary embodiments, at least a portion 414 of the sensor wheel 412 is made of metal. In various other exemplary embodiments, the sensor wheel 412 is made of metal and the portion 414 has a different thickness, for example, is thicker, than the rest of the sensor wheel 412. A magnetic flux source 454 generates a magnetic field that is at least partially intersected by the sensor wheel 412. A magnetic flux sensor 452 is arranged to determine a rotational position of the cam shaft 400 by sensing changes in the magnetic field caused by rotation of the sensor wheel 412.

Similar to that described above with respect to the first exemplary embodiment shown in FIGS. 2 and 3, the second exemplary embodiment operates to determine the rotational position of the cam shaft 400. In each of an extreme clockwise position of the cam shaft 400 and the extreme counterclockwise position of the cam shaft 400, the portion 414 is aligned with or positioned between the magnetic flux source 454 and the magnetic flux sensor 452. Thus, after the drive gear train drives the main drive gear 416 to rotate the cam shaft 400 to the extreme clockwise or counterclockwise position, the portion 414 of the sensor wheel 412 will intersect a certain number of flux lines of the magnetic field generated by the magnetic flux source 454. A number of flux lines of the magnetic field intersected by the portion 414 of the sensor wheel 412 at other rotational positions of the cam shaft 400 will be less than the certain number. Thus, differences in the magnetic flux sensed by the magnetic flux sensor 452 can be used to determine the rotational position of the cam shaft 400. As described above, the controller 460 drives the cam shaft 400 based on the magnetic field sensed by the magnetic flux sensor 452.

Figure 5:
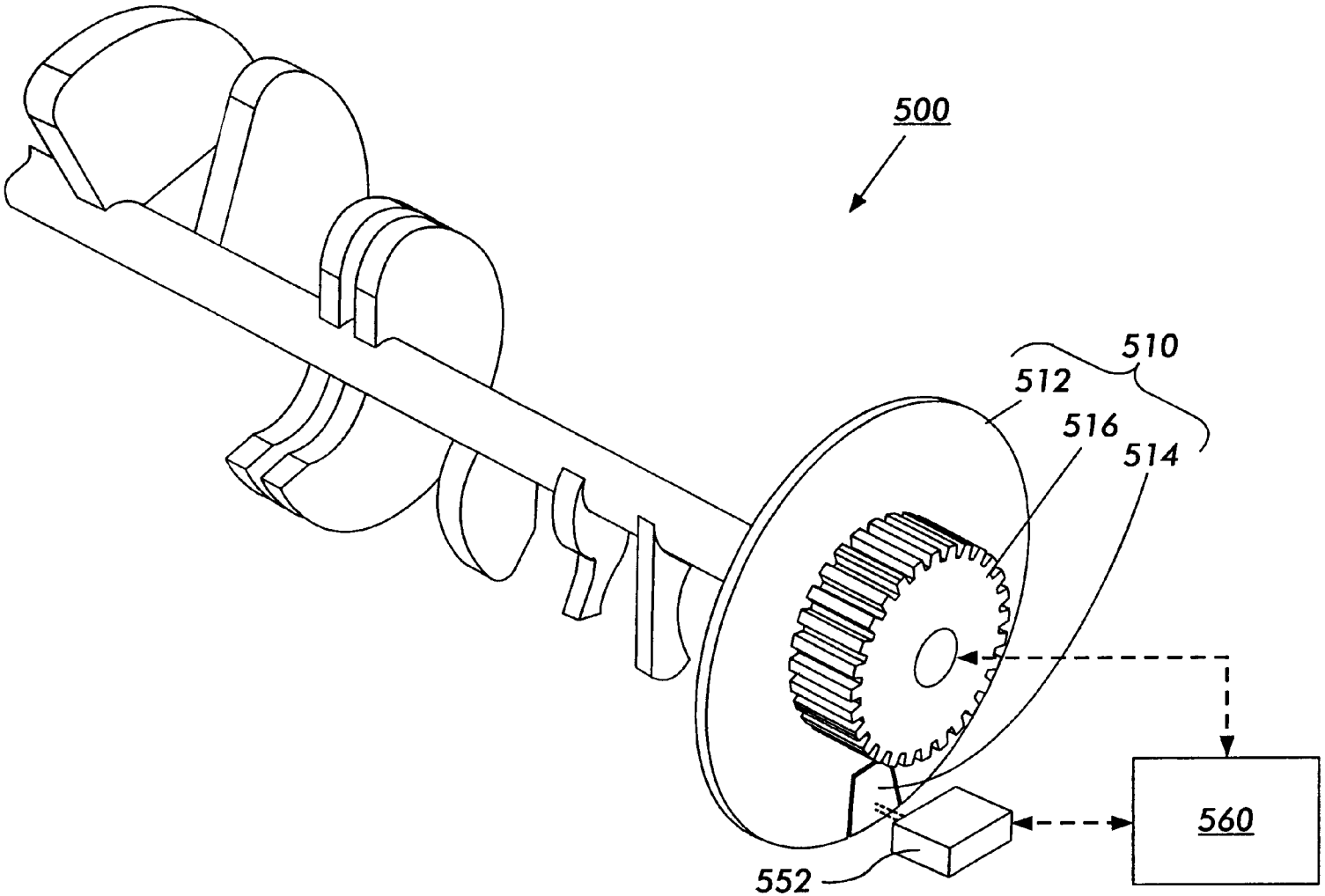
FIG. 5 is a partial perspective view of the cam shaft and a third exemplary embodiment of a sensing arrangement according to this invention.

In a third exemplary embodiment of a sensing arrangement according to this invention, as shown in FIG. 5, the driving and control portion 510 includes a sensor wheel 512 and a main drive gear 516. In operation, a drive gear train, one example of which is shown in FIG. 6, comprising a drive motor connected to one or more drive gears, engages the main drive gear 516 to drive the cam shaft 500 in counterclockwise and then clockwise directions to actuate the various maintenance functions enabled by the maintenance station 1000.

The sensor wheel 512 is arranged to rotate with the cam shaft 500. In various exemplary embodiments, a mechanical element 514 is formed on the sensor wheel 512. As shown in FIG. 5, the mechanical element 514 may be a raised portion that extends from a surface of the sensor wheel 512. It should be understood, however, that the mechanical element 514 may be formed at any suitable location on the sensor wheel 512 and may have any suitable configuration. For example, the mechanical element 514 may be a ramp, a pin, a recess, a notch, or other appropriate known or later developed element.

A mechanical sensor 552 is arranged to determine a rotational position of the cam shaft 500 by cooperating or interacting with the mechanical element 514 as the sensor wheel 512 is rotated. For example, the mechanical element 514 and the mechanical sensor 552 may act as a switch that either initiates or terminates a signal to the controller 460. Thus, the controller 460 may drive the cam shaft 400 based on whether or not the controller 460 receives a signal.

It should be understood that the sensing arrangements described above may be reversed. In other words, the optical window 114 may be formed in the sensor wheel 112 such that only a small section of the sensor wheel 112 may be aligned with the optical sensor 150 at the extreme clockwise and counterclockwise positions of the cam shaft 100. Thus, the optical relay would be in the open-circuit condition when the cam shaft 100 is in its extreme clockwise and counterclockwise positions and in the closed-circuit condition otherwise.

In the second exemplary embodiment, the portion 414 of the sensor wheel 412 that is made of metal may comprise a majority of the sensor wheel 412 or the portion 414 of the sensor wheel 412 that has a different thickness may be thinner than the rest of the sensor wheel 412. Similarly, in the third exemplary embodiment, the mechanical element 514 may be formed on a majority of the sensor wheel 512.

FIG. 6 shows a perspective view of one exemplary embodiment of the maintenance station gear train 1100. The motor drive gear 1110 engages and drives a first gear 1120. The first gear 1120 engages and drives a second gear 1130. The second gear 1130 engages and drives a third gear 1140. The third gear 1140 engages and drives a fourth gear 1150. The fourth gear 1150 in turn activates the drive gear 116. The ratio between the various gears 1110–1150 in the gear train 1100 can be selected to provide any desired conversion factor between the torque and the rotational velocity provided by the drive motor and the desired rotational velocity and torque provided by the cam shaft to the various functional portions of the maintenance station 1000.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for sensoring a maintenance station usable with an ink jet printer, the maintenance station comprising a cam shaft, the method comprising:

sensing a first rotational position of the cam shaft;

rotating the cam shaft to actuate an operation of the maintenance station; and sensing at least a second rotational position of the cam shaft, wherein the first rotational position of the cam shaft and the second rotational position of the cam shaft are approximately 360 degrees apart.

2. The method of claim 1, further comprising controlling the rotating of the cam shaft based on the sensing of the first rotational position of the cam shaft and the sensing of the second rotational position of the cam shaft.

3. The method of claim 1, wherein the operation actuated by rotating the cam shaft comprises at least one of engaging and disengaging a printhead cap with a printhead of an ink jet printer, priming a printhead of an ink jet printer and wiping a nozzle face of a printhead of an ink jet printer.

4. A method for sensoring a maintenance station usable with an ink jet printer, the maintenance station comprising a cam shaft, the method comprising:

sensing a first rotational position of the cam shaft;

rotating the cam shaft to actuate an operation of the maintenance station; and sensing at least a second rotational position of the cam shaft, wherein the first rotational position of the cam shaft sensed is one of an extreme clockwise position of the cam shaft and an extreme counterclockwise position of the cam shaft.

5. The method of claim 4, wherein the second rotational position of the cam shaft sensed is the other of the extreme clockwise position of the cam shaft and the extreme counterclockwise position of the cam shaft.

6. The method of claim 4, further comprising controlling the rotating of the cam shaft based on the sensing of the first rotational position of the cam shaft and the sensing of the second rotational position of the cam shaft.

7. The method of claim 4, wherein the operation actuated by rotating the cam shaft comprises at least one of engaging and disengaging a printhead cap with a printhead of an ink jet printer, priming a printhead of an ink jet printer and wiping a nozzle face of a printhead of an ink jet printer.

8. A method for sensoring a maintenance station usable with an ink jet printer, the maintenance station comprising a cam shaft, the method comprising:

sensing a first rotational position of the cam shaft;

rotating the cam shaft to actuate an operation of the maintenance station;

sensing at least a second rotational position of the cam shaft; and stopping the rotating of the cam shaft for a predetermined time when the second rotational position of the cam shaft is sensed, wherein the second rotational position of the cam shaft is a home position.

9. The method of claim 8, further comprising controlling the rotating of the cam shaft based on the sensing of the first rotational position of the cam shaft and the sensing of the second rotational position of the cam shaft.

10. The method of claim 8, wherein the operation actuated by rotating the cam shaft comprises at least one of engaging and disengaging a printhead cap with a printhead of an ink jet printer, priming a printhead of an ink jet printer and wiping a nozzle face of a printhead of an ink jet printer.

11. A sensoring system for a maintenance station usable with an ink jet printer, the maintenance station comprising a cam shaft, the system comprising:

a sensor wheel that rotates with the cam shaft;

at least one of an optical window, a magnetic flux source and a mechanical element associated with the sensor wheel; and a corresponding sensor arranged to sense a first rotational position of the cam shaft and a second rotation position of the cam shaft, wherein the first rotational position of the cam shaft and the second rotational position of the cam shaft are approximately 360 degrees apart.

12. The system of claim 11, wherein the corresponding sensor is a magnetic flux sensor arranged to determine a rotational position of the cam shaft by sensing the magnetic field.

13. The system of claim 11, wherein the corresponding sensor is a mechanical sensor arranged to determine a rotational position of the cam shaft by cooperating with the mechanical element.

14. The system of claim 11, wherein the corresponding sensor is an optical relay arranged to sense a rotational position of the cam shaft by locating the optical window associated with the sensor wheel.

15. A sensoring system for a maintenance station usable with an ink jet printer, the maintenance station comprising a cam shaft, the system comprising:

a sensor wheel that rotates with the cam shaft;

at least one of an optical window, a magnetic flux source and a mechanical element associated with the sensor wheel; and a corresponding sensor arranged to sense a first rotational position of the cam shaft and a second rotation position of the cam shaft, wherein the first rotational position of the cam shaft sensed is one of an extreme clockwise position of the cam shaft and an extreme counterclockwise position of the cam shaft.

16. The system of claim 15, wherein the corresponding sensor is an optical relay arranged to sense a rotational position of the cam shaft by locating the optical window associated with the sensor wheel.

17. The system of claim 15, wherein the corresponding sensor is a magnetic flux sensor arranged to determine a rotational position of the cam shaft by sensing the magnetic field.

18. The system of claim 15, wherein the corresponding sensor is a mechanical sensor arranged to determine a rotational position of the cam shaft by cooperating with the mechanical element.

19. A sensoring system for a maintenance station usable with an ink jet printer, the maintenance station comprising a cam shaft, the system comprising:

a sensor wheel that rotates with the cam shaft;

at least one of an optical window, a magnetic flux source and a mechanical element associated with the sensor wheel;

a corresponding sensor arranged to sense a first rotational position of the cam shaft and a second rotation position of the cam shaft; and a controller that stops the rotating of the cam shaft for a predetermined time when the second rotational position of the cam shaft is sensed, wherein the second rotational position of the cam shaft is a home position.

20. The system of claim 19, wherein the corresponding sensor is an optical relay arranged to sense a rotational position of the cam shaft by locating the optical window associated with the sensor wheel.

21. The system of claim 19, wherein the corresponding sensor is a magnetic flux sensor arranged to determine a rotational position of the cam shaft by sensing the magnetic field.

22. The system of claim 19, wherein the corresponding sensor is a mechanical sensor arranged to determine a rotational position of the cam shaft by cooperating with the mechanical element.

* * * * *